US006293645B1

(12) United States Patent
Kim

(10) Patent No.: US 6,293,645 B1
(45) Date of Patent: Sep. 25, 2001

(54) METHOD AND A DEVICE FOR DETECTING CLOGGED NOZZLES

(75) Inventor: Han-Sin Kim, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/185,746

(22) Filed: Nov. 4, 1998

(30) Foreign Application Priority Data

Nov. 4, 1997 (KR) ..... 97-57858

(51) Int. Cl.[7] ..... B41J 2/165; B41J 29/393
(52) U.S. Cl. ..... 347/23; 347/19
(58) Field of Search ..... 347/23, 37, 43, 347/40, 19

(56) References Cited

U.S. PATENT DOCUMENTS 4,907,013 * 3/1990 Hubbard et al. ..... 347/19
5,387,976 * 2/1995 Lesniak ..... 347/19
5,798,773 * 8/1998 Hiramatsu et al. ..... 347/19

FOREIGN PATENT DOCUMENTS

559370 * 9/1993 (EP) .

* cited by examiner

*Primary Examiner*—Thinh Nguyen
(74) *Attorney, Agent, or Firm*—Robert E. Bushnell, Esq.

(57) ABSTRACT

A device and a method for automatically detecting and clearing clogged nozzles. To detect clogged nozzles a print head controller causes a print head to print on a sheet of paper by sending a number of electric signals that cause the print head to expel ink through nozzles. The print head controller sends an electric-signal causing a print head to print. A scanner scans the area on the paper where the print head was supposed to have ejected ink. Then, an image processor converts the read data into binary data. The binary data is then analyzed by a detection processor that determines if there is any indication of missing ink drops. If missing ink drops are detected, a nozzle cleaning processor sends signals to the print head to cause the clogged nozzles to purge and expel impurities so that optimum printing quality is restored.

19 Claims, 3 Drawing Sheets

METHOD AND A DEVICE FOR DETECTING CLOGGED NOZZLES

CLAIM OF PRIORITY

This application makes reference to, incorporates the same herein, and claims all benefits accruing under 35 U.S.C. §119 from my application entitled Device of Detecting Stopped Nozzles and Method Therefor filed with the Korean Industrial Property Office on Nov. 4, 1997 and there duly assigned Serial No. 97-57858 by that Office.

BACKGROUND OF THE INVENTION

1. Field of the Invention

The present invention relates to a device and a method for detecting a clogged nozzle in an ink cartridge and, more specifically, to a device and method for detecting a clogged nozzle and automatically unclogging the nozzles to allow the proper printing operation of the electrophotographic apparatus.

2. Background Art

Sometimes, one of a couple nozzles that are used in an ink cartridge is clogged and ceases to allow ink to be expelled from the cartridge. This can happen when foreign matter gets inside of a nozzle or when a nozzle is not used for a while.

Generally, one only detects that a nozzle is clogged when one visually detects voids in the printing that is performed on a cut sheet of paper. These spots that are formed by the failure of ink to appear on the paper indicates that at least one nozzle may be clogged. To clean the one nozzle that is clogged an electric signal must be sent to each nozzle causing the nozzles to eject ink. This can be inconvenient because it requires a user to check each printing visually to insure that every nozzle is working properly. This can slow down a user's efficiency at document production and lower consumer satisfaction with the purchased printer. Accordingly in a conventional case, there has been a problem that the existence of dot-open of printed papers must be checked one by one in order to detect clogged nozzles.

I believe that it may be possible to improve on the contemporary art by providing a method and a device for automatically detecting the clogging of a nozzle and then automatically sending the necessary signal to clear the nozzle and allow unimpeded printing.

SUMMARY OF THE INVENTION

Accordingly, it is an object of the present invention to provide a method and a device for detecting clogged nozzles in an ink-cartridge.

It is another object to provide a method and a device for detecting clogged nozzles in an ink-cartridge that can automatically send a signal to clear an individual nozzle when a clogged nozzle is detected.

It is another object to provide a method and a device for detecting clogged nozzles in an ink-cartridge that can automatically clear all the nozzles in an ink cartridge when a clogged nozzle is detected.

It is still another object to provide a method and a device for detecting clogged nozzles in an ink-cartridge that increases a user's efficiency of document production by simplifying the clearing of clogged nozzles.

To achieve these and other objects, a device and a method are provided for automatically detecting and clearing clogged nozzles. To detect clogged nozzles a device as constructed according to the principles of the present invention may be constructed using a print head controller that causes the print head to print on a sheet of cut paper by sending a number of electric signals that cause the print head to expel ink through a nozzle. The print head controller sends an electric-signal to cause a print head to print when a mode-signal is received that causes the controller to start the clogged nozzle detection process. A scanner, that may also be attached to the carriage that carries the ink cartridge, scans the area on the paper where the print head was supposed to have ejected ink. Then, an image processor converts the read data and converts it into binary data. The binary data is then analyzed by a detection processor that determines if there is any indication of missing ink drops. If missing ink drops are detected, a nozzle cleaning processor sends signals to the print head to cause the clogged nozzles to expel ink or to cause all of the nozzles to expel ink.

A method for determining whether a nozzle is clogged, starts with determining whether a clogged-nozzle-detection-mode is on. If the clogged-nozzle-detection-mode is off then the method is aborted. Otherwise, a printing operation is performed on a cut sheet of paper. Then, during the next step, the area of the paper that should have been printed upon is scanned. After, the read data is converted to image data. Then, during the next step, the binary data is analyzed to determine whether voids or imperfections existed in the printing. If the improper absence of ink is not detected then the method ends. If the binary analysis determines that there are areas devoid of ink, then an alert is sent to a user of the computer system. During the next step, signals are sent to the print head to cause the nozzles to clear any clogs that may exist.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols represent the same or similar components, wherein.

DETAILED DESCRIPTION OF THE DRAWINGS

Figure 1:
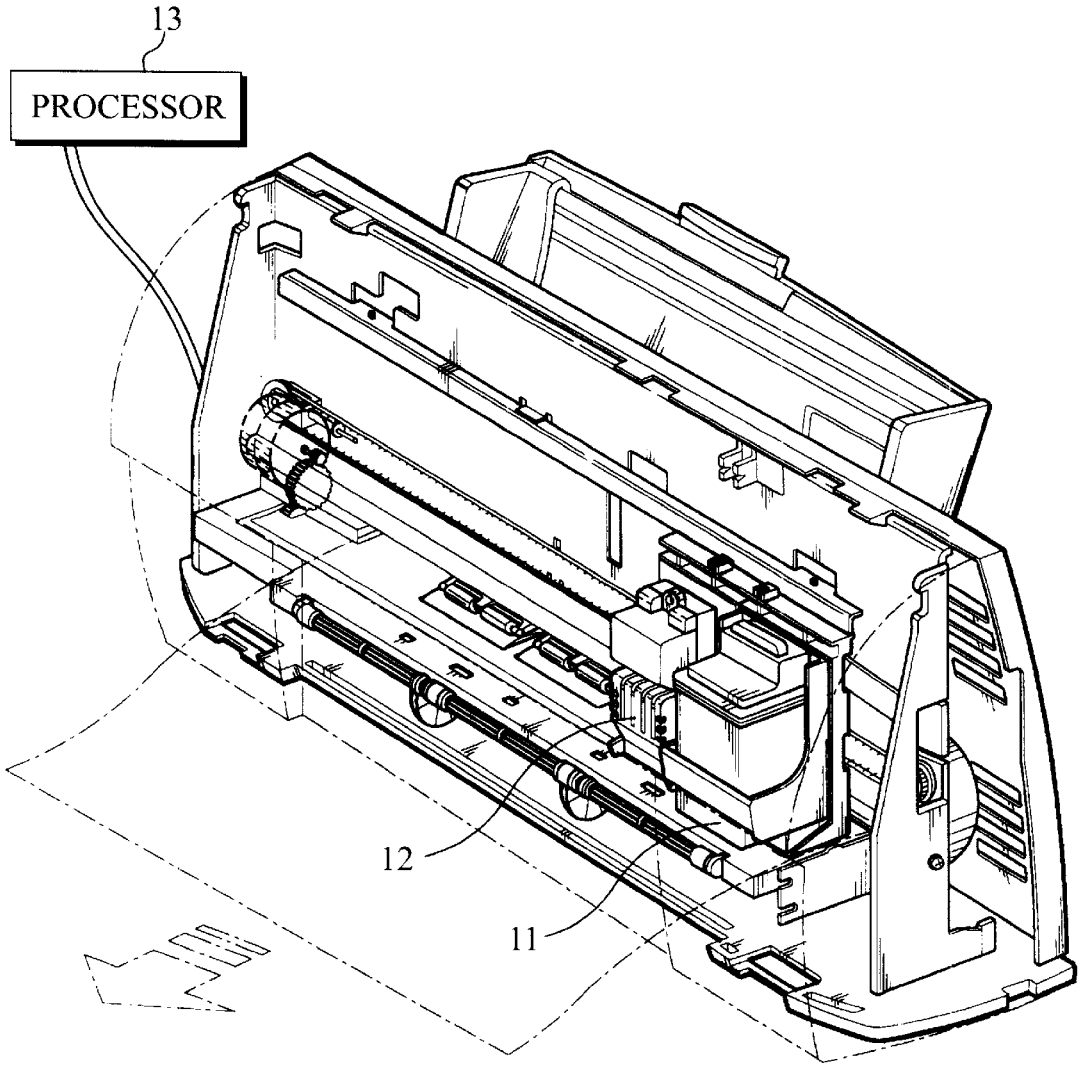
FIG. 1 is a partial cut-away view of an electrophotographic apparatus.

Turning now to the drawings, FIG. 1 illustrates a printer that has a scanner module mounted on carriage 14 of an ink jet printer. Scanner module 12 is mounted on the same carriage as ink cartridge module 11 and is carried along the same reciprocating path inside of the printer housing. The printer having such a constitution is called a complex apparatus. Scanner module 12 and ink cartridge 11 are moved along shaft 15 by belt 16. Processor 13 may be located inside the printer housing or inside of a computer system. The processor contains all of the controllers and processors used by the present invention.

Figure 2:
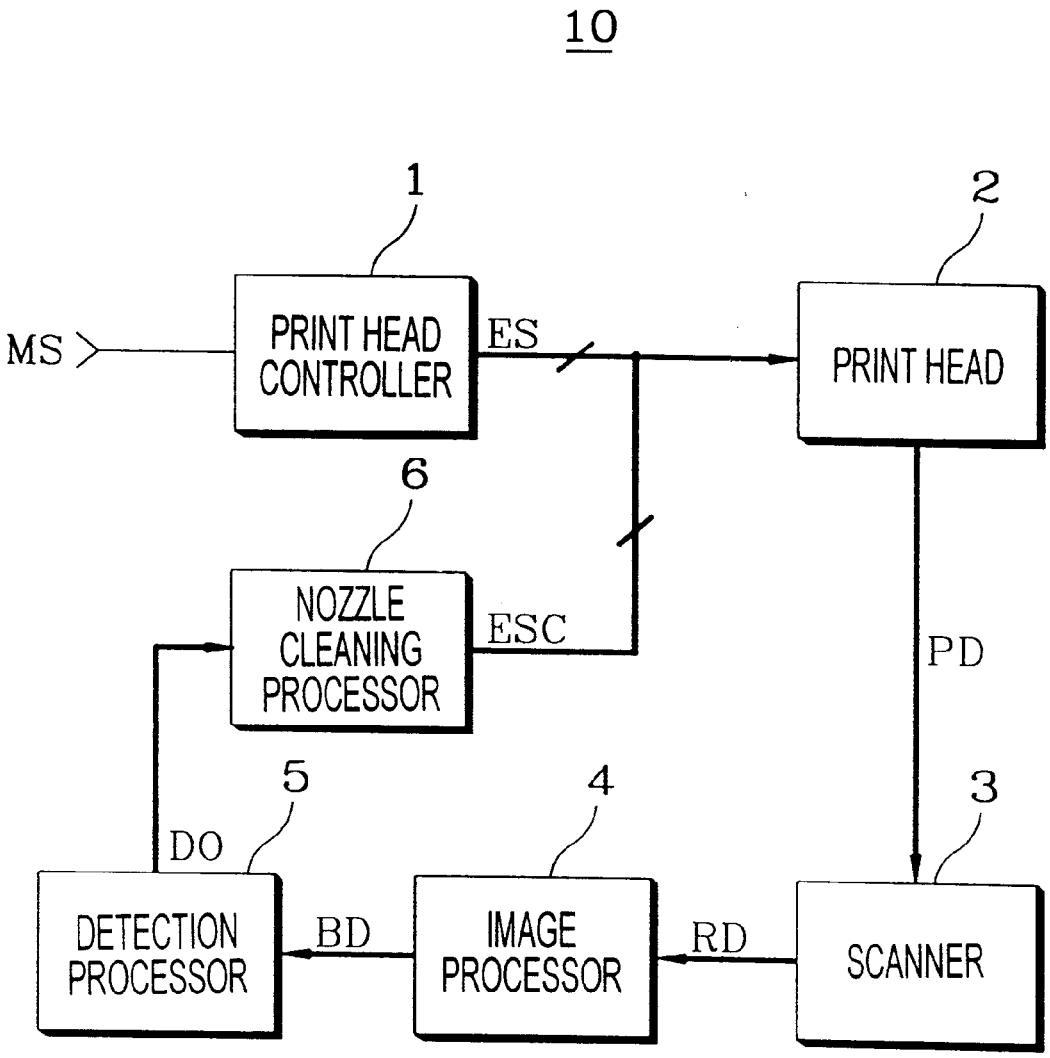
FIG. 2 is a block diagram of a device for detecting and clearing clogged nozzles in a print head as constructed according to the principles of the present invention.

FIG. 2 illustrates a block diagram of a device for detecting and clearing a clogged nozzle as constructed according to the principles of the present invention. Device 10 may be constructed using print head controller 1 to receive signals initiating a detect-clogged-nozzles-mode and to send electric-signals to print head 2. Electric-signals, denoted 'ES', can be sent to print head 2 to cause the print head to perform a printing operation. This generates print-data, denoted 'PD', that is read by scanner 3. Then, the read data, denoted 'RD', is sent to image processor 4 to be converted into binary data, denoted 'BD'. The binary data is analyzed by detection processor 5 to determine if there is any ink missing within the area that the print head should have printed on the paper. If the detection processor determines that ink is missing, then it computes which nozzles are clogged and sends a data output, denoted 'DO', to nozzle cleaning processor 6. The data output contains information as to which nozzles are clogged. Then, nozzle cleaning processor 6 sends electronic signals, or purge-signals, denoted 'ESC', to any combination of nozzles to clear the clogs and restore the designed level of quality to the printer operations. The nozzle cleaning processor can be arranged to only send signals to the particular nozzles that are clogged or to send a signal to all of the nozzles causing them all to purge and remove impurities. One advantage of only purging the appropriate nozzles is that ink is not wasted.

All of the processors and the controller described above can be integrated into a single controller that can be located inside the printer housing or in a computer system that the printer is attached to. Alternatively, the processors can be broken into any subcombination of controllers that are used to regulate the process. The operation of device 10 while detecting and clearing clogged nozzles is as follows.

Print head controller 1 outputs a number of electric signals, denoted 'ES', to expel ink from the print head in response to a detect-clogged-nozzles-mode signal, denoted 'MS'. Print head 2 prints on a portion of a cut sheet of paper. After the print head is carried past the designated point on the paper, a scanner, that is mounted to the same carriage as the print head, is transported past the designated point. While the scanner passes over the location where the printing should have occurred it records image data from the paper. Then, this read data, denoted 'RD', is sent to an image processor that transforms the read data into binary data, denoted 'BD'. This binary data is then analyzed by a detection processor. The detection processor analyzes the binary data to determine if there is an absence of ink where the printing operation is supposed to have occurred. If an absence of ink is detected, then data output, denoted 'DO', is sent to a nozzle cleaning processor. Nozzle cleaning processor 6 then sends electronic signals, denoted 'ESC', to the nozzles of the print head to cause the nozzles to purge and clear any obstruction. The device can be designed to purge all the nozzles when a clogged nozzle is detected. In addition, the device can be designed to only purge the nozzles that are clogged as determined by the detection processor.

Figure 3:
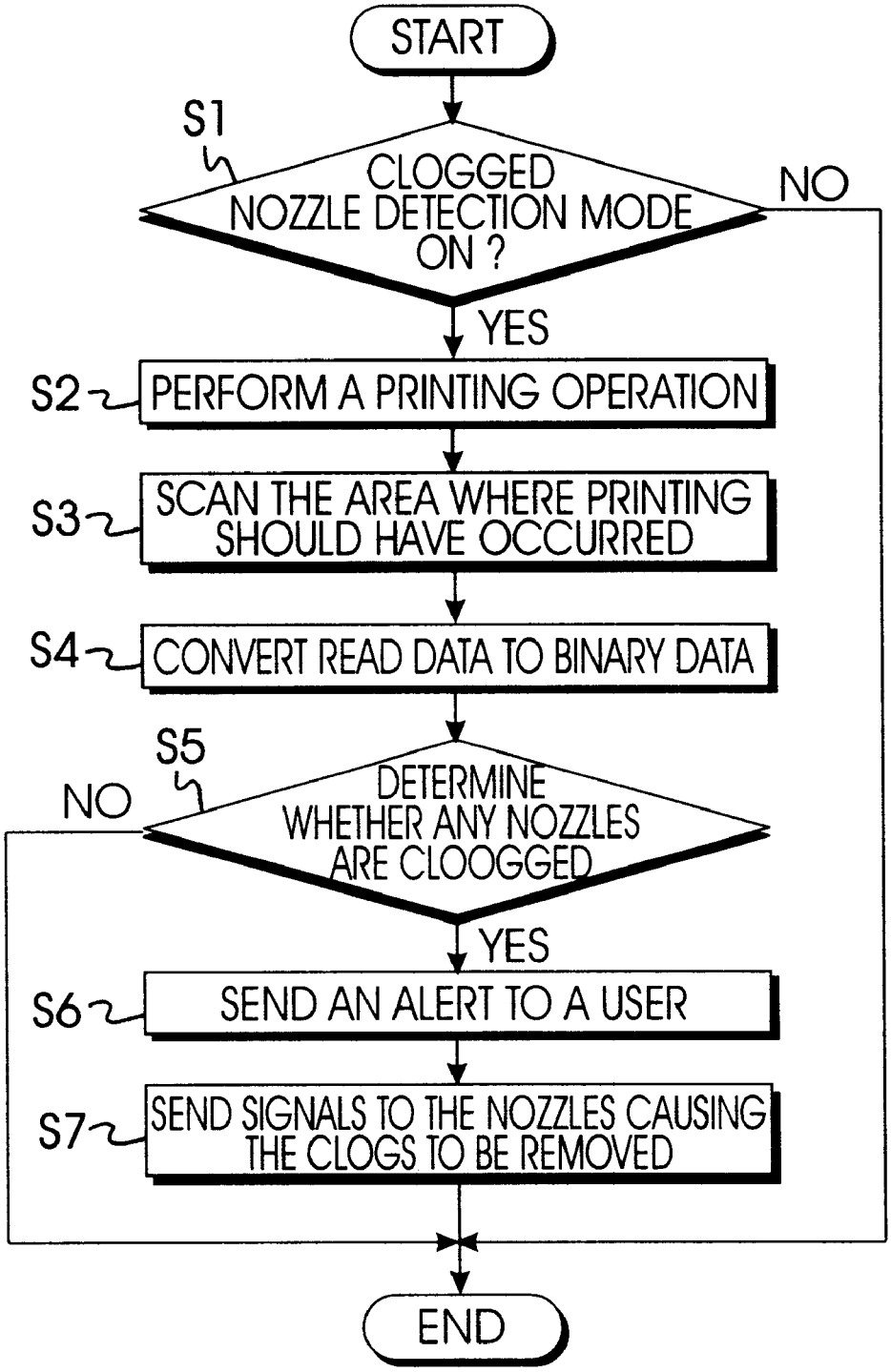
FIG. 3 is a flow chart of a method for detecting and clearing clogged nozzles according to the principles of the present invention.

FIG. 3 illustrates a flow chart of a method for detecting and clearing clogged nozzles according to the principles of the present invention. A method for determining whether a nozzle is clogged, starts, during step S1, with determining whether a clogged-nozzle-detection-mode is on. If the clogged-nozzle-detection-mode is off then the method is aborted and the process ends. Otherwise, step S2 is performed and a printing operation is preformed on a cut sheet of paper. Then, during step S3, the area of the paper that should have been printed upon is scanned. The scanner generates read data that correlates to the area upon which printing should have occurred. After, in step S4, the read data is converted to binary data. For example, a low logic level can be used to indicate an absence of ink and a high logic-level can be used to indicate the presence of ink. Then, during step S5, the binary data is analyzed to determine whether voids or imperfections existed in the printing. If the improper absence of ink is not detected then the method ends. If the binary analysis determines that there are areas devoid of ink, then step S6 is executed and an alert is sent to a user of the computer system. The alert describes the pertinent information regarding the problem with the ink cartridge. Then, during step S7, signals arc sent to the print head to cause the nozzles to purge any clogs that may exist.

The present invention can conveniently detect and clean clogged nozzles by performing a purging of the nozzles using an electric signal. By only purging the nozzles that are clogged, the method and device prevent the unnecessary waste of ink.

Although preferred embodiments of the present invention have been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. A printer, comprising:

a body enclosing a means for forming images on a printable medium;

a carriage slidably attached to a shaft disposed inside said body;

a print head attached to said carriage, said print head having a plurality of nozzles that propel ink drops onto said printable medium;

a scanner attached to said carriage;

a controller sending a print-command to said print head to mark a portion of said printable medium;

said scanner reading said portion of said printable medium;

an image processor converting data read by said scanner into binary data; and said controller determining from said binary data whether any nozzle of said plurality of nozzles is clogged by determining whether ink drops are missing from said portion of said printable medium and then selectively sending a purge signal only to each nozzle determined from said binary data to be clogged of said plurality of nozzles to selectively purge only each nozzle determined to be clogged of said plurality of nozzles.

2. The printer of claim 1, further comprised of said binary data being comprised of a plurality of bits, with each bit of said binary data indicating whether a corresponding one of said plurality of nozzles is clogged, said binary data being input to said controller to notify said controller of any of said plurality of nozzles indicated to be clogged dependent upon a logic level of a corresponding bit of said plurality of bits of said binary data.

3. A method of detecting and selectively clearing a clogged nozzle of a plurality of nozzles in an ink cartridge, comprising the steps of:

performing a printing operation on a portion of a sheet of paper;

scanning said portion of said sheet of paper to generate read data;

analyzing said read data to determine whether all of said plurality of nozzles are expelling ink; and when any nozzle of said plurality of nozzles is determined to be clogged from analyzing said read data, then selectively sending a purge signal only to each nozzle determined from said read data to be clogged of said plurality of nozzles to selectively purge only each nozzle determined to be clogged to restore normal operation.

4. The method of claim 3, further comprised of said step of performing a printing operation further comprising having a controller send a print signal to an ink cartridge bearing said plurality of nozzles.

5. The method of claim 4, further comprised of said step of analyzing said read data further comprising converting said read data into binary data, said binary data comprising a plurality of bits, each bit representing whether a corresponding one of said plurality of nozzles of said ink cartridge is clogged.

6. The method of claim 5, further comprised of when a corresponding one of said plurality of bits has a low-logic level a corresponding one of said plurality of nozzles is determined to be clogged and when a corresponding one of said plurality of bits has a high-logic level a corresponding one of said plurality of nozzles is determined to be unclogged.

7. The method of claim 6, further comprised of said step of analyzing said read data further comprising analyzing said binary data by a detection processor.

8. The method of claim 7, further comprised of said step of selectively sending a purge signal only to each nozzle determined from said read data to be clogged further comprises sending, via a nozzle cleaning processor, each said purge signal to said ink cartridge.

9. A printer, comprising:

a body enclosing a means for forming images on a cut sheet of a printable medium, said body comprising:
a shaft attached to an inner surface of said body;
a carriage attached to said shaft for sliding movement;
a monitor attached to said body; and
a belt transferring power from a motor to said carriage to move said carriage in a reciprocating manner;

a print head attached to said carriage, said print head having a plurality of nozzles that propel a plurality of ink drops onto said printable medium;

a scanner attached to said carriage;

a controller for sending a print command to said print head to mark a portion of said printable medium;

said scanner for reading said portion of said printable medium and generating a read data signal;

an image processor for converting said read data signal into a binary data signal; and a detection processor that determines whether said binary data signal corresponds to any of said plurality of nozzles being clogged to selectively purge only each nozzle determined from said binary data signal to be clogged of said plurality of nozzles.

10. The printer of claim 9, further comprising a nozzle cleaning processor for receiving data output from said detection processor indicating each nozzle determined from said binary data signal to be clogged of said plurality of nozzles and for sending out a purge signal only to each nozzle determined from said binary data signal to be clogged of said plurality of nozzles to selectively purge only each nozzle determined to be clogged of said plurality of nozzles.

11. The printer of claim 10, further comprised of said binary data signal being comprised of a plurality of bits, with each bit of said binary data signal corresponding to one of said plurality of nozzles in said print head to indicate whether a corresponding one of said plurality of nozzles is clogged.

12. The printer of claim 9, further comprising a nozzle cleaning processor receiving data output from said detection processor corresponding to each bit of said binary data signal that is at a logic level indicating a corresponding nozzle of said plurality of nozzles is clogged and for sending out a purge signal only to each nozzle indicated to be clogged of said plurality of nozzles to selectively purge only each nozzle indicated to be clogged of said plurality of nozzles.

13. A method of detecting clogging in a plurality of nozzles in an ink cartridge, comprising the steps of:

performing a printing operation on a portion of a sheet of paper;

scanning said portion of said sheet of paper to generate read data;

converting said read data into binary data via a converter, said binary data having a plurality of bits, each one of said plurality of bits indicating whether a corresponding one of said plurality of nozzles in said ink cartridge is clogged; and analyzing said binary data to determine whether any of said plurality of nozzles is clogged to selectively purge only each nozzle determined from said binary data to be clogged of said plurality of nozzles.

14. The method of claim 13, further comprising the step of when any of said plurality of nozzles is determined from said binary data to be clogged, then selectively sending a purge signal to only each nozzle determined to be clogged of said plurality of nozzles to restore normal operation.

15. The method of claim 14, further comprised of said step of performing a printing operation further comprising sending by a controller a print signal to an ink cartridge bearing said plurality of nozzles.

16. The method of claim 15, further comprised of said binary data having a low-logic level to indicate a clogged nozzle and said binary data having a high-logic level to indicate an unclogged nozzle.

17. The method of claim 16, further comprised of said step of analyzing said binary data further comprising said binary data being analyzed by a detection processor.

18. The method of claim 17, further comprised of said step of selectively sending a purge signal further comprising sending, via a nozzle cleaning processor, each said purge signal to said ink cartridge.

19. The method of claim 13, further comprising the step of sending, via a nozzle cleaning processor, a purge signal only to each nozzle determined to be clogged of said plurality of nozzles.

* * * * *